US011493233B2

(12) United States Patent
Harman et al.

(10) Patent No.: US 11,493,233 B2
(45) Date of Patent: Nov. 8, 2022

(54) DIRECT HIGH VOLTAGE WATER HEATER

(71) Applicant: STONE AEROSPACE, INC., Del Valle, TX (US)

(72) Inventors: John Harman, Keyser, WV (US); Frederick M. Smith, Lavale, MD (US); William C. Stone, Del Valle, TX (US)

(73) Assignee: Stone Aerospace, Inc., Del Valle, TX (US)

( * ) Notice: Subject to any disclaimer, the term of this patent is extended or adjusted under 35 U.S.C. 154(b) by 177 days.

(21) Appl. No.: 15/660,941

(22) Filed: Jul. 26, 2017

(65) Prior Publication Data

US 2018/0087804 A1 Mar. 29, 2018

Related U.S. Application Data

(60) Provisional application No. 62/399,846, filed on Sep. 26, 2016.

(51) Int. Cl.

| | |
|---|---|
| ***F24H 1/10*** | (2022.01) |
| ***E21B 7/00*** | (2006.01) |
| ***E21B 7/15*** | (2006.01) |

(52) U.S. Cl.
CPC ..... *F24H 1/106* (2013.01); *E21B 7/008* (2013.01); *E21B 7/15* (2013.01)

(58) Field of Classification Search
CPC . F24H 1/106; E21B 7/008; E21B 7/15; F22B 1/30

(Continued)

(56) References Cited

U.S. PATENT DOCUMENTS 1,362,356 A 12/1920 Schneider
1,827,639 A 10/1931 Boshetti
(Continued)

FOREIGN PATENT DOCUMENTS

CN 203464470 U * 3/2014
CN 104110835 A * 10/2014 ..... F24H 9/0047
(Continued)

OTHER PUBLICATIONS

Dughaish, Z.H., Lead telluride as a thermoelectric material for thermoelectric power generation, Physica 8: Condensed Matter, vol. 322, Issues 1-2, 2002, pp. 205-223.
(Continued)

*Primary Examiner* — Ibrahime A Abraham
*Assistant Examiner* — Elizabeth M Kerr
(74) *Attorney, Agent, or Firm* — Miguel Villarreal, Jr.; Gunn, Lee & Cave, P.C.

(57) ABSTRACT

A direct high voltage flow-through water heater system transmits high voltage power to a remote ice penetrating robot, converts the power to heat in a very small space, and then uses the heat to melt the ice, providing a path ahead of the robot allowing penetration deeper into a remote ice-covered location, such ice of substantial (e.g., kilometers) thickness, such as, for example, glacial ice caps. High voltage, low current, AC power is passed through a moving conducting fluid, inducing resistive heating in the fluid with 100% efficiency. The exiting fluid is stripped of common mode voltage before exiting. Energy transfer from the electrical source to the fluid is instantaneous and occurs at 100% efficiency. In an alternative embodiment, the fluid heater system operates at standard residential/industrial mains voltages and runs from 220 VAC as other applications of the present invention include the traditional water heater industry as well.

6 Claims, 6 Drawing Sheets

(58) Field of Classification Search
USPC ..... 392/320
See application file for complete search history.

(56) References Cited

U.S. PATENT DOCUMENTS

| | | | | | |
|---|---|---|---|---|---|
| 1,941,584 | A * | 1/1934 | George | F24H 1/106 | 392/338 |
| 2,481,958 | A | 9/1949 | Videche | | |
| 2,807,702 | A | 9/1957 | Gomez | | |
| 3,005,083 | A * | 10/1961 | Mendoza | F24H 1/106 | 392/338 |
| 3,299,252 | A * | 1/1967 | Meek | F24H 1/106 | 392/314 |
| 3,753,537 | A | 8/1973 | Karpa et al. | | |
| 3,815,511 | A | 5/1974 | Staal | | |
| 3,825,211 | A | 7/1974 | Minovitch | | |
| 3,946,197 | A * | 3/1976 | Williams | F24H 1/106 | 392/315 |
| 4,029,937 | A * | 6/1977 | Russell | F24H 1/106 | 392/318 |
| 1,139,669 | A | 3/1984 | Ryffel | | |
| 4,730,098 | A | 3/1988 | Cave | | |
| 4,860,968 | A | 8/1989 | Pinson | | |
| 5,022,603 | A | 6/1991 | Maree et al. | | |
| 5,039,193 | A | 6/1991 | Snow et al. | | |
| 5,044,573 | A | 9/1991 | LeCompte | | |
| 5,058,969 | A | 10/1991 | Peterson et al. | | |
| 5,074,489 | A | 12/1991 | Gamzon | | |
| 5,099,144 | A | 3/1992 | Sai | | |
| 5,248,931 | A | 9/1993 | Flesner et al. | | |
| 5,260,639 | A | 11/1993 | DeYoung et al. | | |
| 5,310,134 | A | 5/1994 | Hsu et al. | | |
| 5,436,553 | A | 7/1995 | Pepper et al. | | |
| 5,440,667 | A | 8/1995 | Simpson et al. | | |
| 5,490,973 | A * | 2/1996 | Grothaus | B01D 53/32 | 422/168 |
| 5,502,356 | A | 3/1996 | McGeoch | | |
| 5,564,649 | A | 10/1996 | Von Hoessle et al. | | |
| 5,686,694 | A | 11/1997 | Hillenbrand et al. | | |
| 5,748,102 | A | 5/1998 | Barron | | |
| 6,167,831 | B1 | 1/2001 | Watt et al. | | |
| 6,223,675 | B1 | 5/2001 | Watt et al. | | |
| 6,257,162 | B1 | 7/2001 | Watt et al. | | |
| 6,262,357 | B1 | 7/2001 | Johnson et al. | | |
| 6,307,156 | B1 | 10/2001 | Avellanet | | |
| 6,390,012 | B1 | 5/2002 | Watt et al. | | |
| 6,407,535 | B1 | 6/2002 | Friedman et al. | | |
| 6,411,565 | B1 | 6/2002 | Sirmalis et al. | | |
| 6,488,233 | B1 | 12/2002 | Myrabo | | |
| 6,491,258 | B1 | 12/2002 | Boyd et al. | | |
| 6,534,705 | B2 | 3/2003 | Berrios et al. | | |
| 6,669,126 | B1 | 12/2003 | Albert et al. | | |
| 6,828,579 | B2 | 12/2004 | Ghamaty et al. | | |
| 6,910,658 | B1 | 6/2005 | Hart et al. | | |
| 6,914,343 | B2 | 7/2005 | Hiller et al. | | |
| 6,964,509 | B2 | 11/2005 | Gozum et al. | | |
| 6,968,112 | B2 | 11/2005 | Zamel et al. | | |
| 7,263,245 | B2 | 8/2007 | Delcher et al. | | |
| 7,342,170 | B2 | 3/2008 | Ghamaty et al. | | |
| 7,356,209 | B2 | 4/2008 | Delcher et al. | | |
| 7,540,265 | B2 | 6/2009 | Willems et al. | | |
| 8,532,474 | B2 | 9/2013 | Campbell | | |
| 9,577,416 | B2 * | 2/2017 | Nisslbeck | H01B 1/02 | |
| 10,281,138 | B2 * | 5/2019 | Mahoney | F22B 1/30 | |
| 10,524,611 | B2 * | 1/2020 | Kelly | A47J 31/542 | |
| 2002/0046763 | A1 | 4/2002 | Berrios et al. | | |
| 2003/0111660 | A1 | 6/2003 | Ghamaty et al. | | |
| 2004/0149485 | A1 | 8/2004 | Edwards | | |
| 2004/0163709 | A1 | 8/2004 | Baugh et al. | | |
| 2004/0163802 | A1 | 8/2004 | Baugh et al. | | |
| 2004/0182732 | A1 | 9/2004 | Zamel et al. | | |
| 2004/0238022 | A1 | 12/2004 | Hiller et al. | | |
| 2005/0028857 | A1 | 2/2005 | Ghamaty et al. | | |
| 2005/0126624 | A1 | 6/2005 | Pellizzari | | |
| 2006/0289724 | A1 | 12/2006 | Skinner et al. | | |
| 2007/0056262 | A1 | 3/2007 | Leach et al. | | |
| 2008/0056642 | A1 | 3/2008 | Byer et al. | | |
| 2008/0134952 | A1 | 6/2008 | Tull | | |
| 2009/0086309 | A1 | 4/2009 | Moosburger | | |
| 2009/0206697 | A1 | 8/2009 | Marshal et al. | | |
| 2009/0251271 | A1 | 10/2009 | Stelzer et al. | | |
| 2009/0296746 | A1 | 12/2009 | Heaton et al. | | |
| 2010/0044103 | A1 | 2/2010 | Moxley et al. | | |
| 2010/0044106 | A1 | 2/2010 | Zediker et al. | | |
| 2010/0215326 | A1 | 8/2010 | Zediker et al. | | |
| 2010/0275576 | A1 | 11/2010 | Gutman et al. | | |
| 2010/0322605 | A1 * | 12/2010 | van Aken | F22D 1/00 | 392/466 |
| 2012/0068086 | A1 | 3/2012 | DeWitt et al. | | |
| 2013/0099182 | A1 * | 4/2013 | Rebouillat | H01B 3/22 | 252/579 |
| 2016/0000262 | A1 * | 1/2016 | Kelly | A47J 31/545 | 392/478 |
| 2016/0049781 | A1 * | 2/2016 | Nisslbeck | H01B 1/02 | 174/650 |
| 2017/0153022 | A1 * | 6/2017 | Mahoney | F22B 1/30 | |

FOREIGN PATENT DOCUMENTS

| | | | | |
|---|---|---|---|---|
| CN | 104534673 | A * | 4/2015 | |
| GB | 2196820 | B | 1/1990 | |
| JP | 2001132542 | A | 5/2001 | |
| JP | 2002193555 | A | 7/2002 | |
| KR | 20030057767 | A * | 7/2003 | |
| NZ | 510301 | A * | 6/2001 | F24H 9/0047 |

OTHER PUBLICATIONS

Hecht, Jeff, Photonic Frontiers: Photonic power delivery: Photonic power conversion delivers power via laser beams, 2006, Laser Focus World, available at https://www.laserfocusworld.com/articles/print!volume-42/issue-1/features/photonic-frontiersphotonic-power-delivery-photonic-power-conversion-delivers-power-via-laser-beams.html.

Hussein, H., A novel delivery for laser thermal recanalization, Images of the Twenty-First Century. Proceedings of the Annual International Engineering in Medicine and Biology Society, Seattle, WA, 1989, pp. 1190-1191 vol. 4.

Lorenz, R.D., Subsurface ambient thermoelectric power for moles and penetrators, 2003 IEEE Aerospace Conference Proceedings (Cat. No.03TH8652), 2003, pp. 2_637-2_642.

Ritz et al., Multi-mission radioisotope thermoelectric generator (MMRTG) program overview, 20041EEE Aerospace Conference Proceedings (IEEE Cat. No.04TH8720), 2004, pp. 2957 vol.5.

* cited by examiner

DIRECT HIGH VOLTAGE WATER HEATER

CROSS REFERENCE TO RELATED APPLICATIONS

This original non-provisional application claims priority to and the benefit of U.S. provisional application Ser. No. 62/399,846, filed Sep. 26, 2016, and entitled "Thermal High Voltage Ocean Penetrator Research Platform," which is incorporated by reference herein.

STATEMENT REGARDING FEDERALLY SPONSORED RESEARCH OR DEVELOPMENT

This invention was made with Government support under Grant No. NNX15AT32G and 80NSSC18K1040 awarded by NASA. The Government has certain rights in this invention.

BACKGROUND OF THE INVENTION

1. Field of the Invention

The present invention relates to hot water heaters and more specifically to direct high voltage flow through water heater systems.

2. Description of the Related Art

Robotic exploration and life search on ocean worlds requires the ability to access habitable ocean environments concealed beneath thick ice crusts. Additionally, an instrument suite is required to perform the complicated task of autonomous life detection and initial characterization of the new, unexplored environment. A cryobot, or ice penetrating vehicle, may be used to perform these technological and operational requirements for ocean world access.

Such a vehicle will be deployed at the Skáftáketill Caldera ("Skafta") in Vatnajökull, Iceland where it will penetrate the thick ice cover (300 m) to enter the volcanic crater's subglacial lake. Upon reaching the ice-water interface, the cryobot will transition into an instrument sonde and spool itself to the lake floor while sampling and analyzing the water column. As the vehicle descends, input from the sensor suite will govern decision-to-collect behaviors to trigger processes such as water sampling.

Space is a premium real estate in such a vehicle or robot. The vehicle must be large enough to contain all the components required to perform, but small enough to minimize power consumption and reduce its field-logistics footprint, thereby minimizing any negative effects on its surroundings. Of concern is the ice melting capabilities of the ice penetrating vehicle, and in particular, how to transmit high voltage power to a remote ice penetrating robot, convert the power to heat in a very small space, and then use that to melt the ice.

Past high voltage cryobots utilize passive, resistive heating elements in the nose and/or sidewall of the vehicle. In these vehicles, the maximum descent speed is limited by the maximum thermal transfer across the hotplate/ice boundary. Water at the interface between the melt head and the ice acts as an insulator and limits the rate of heat transfer. To increase the thermal flux across the hotplate/ice boundary, the temperature of the hot plate must be driven higher. Maximum hot plate temperature and, therefore, melt rate is constrained by maximum thermal material limits.

In contrast, hot water drilling/jetting does not suffer from thermal boundary limitations since heat flux into the ice is controlled by pumping speed. Hot water drilling systems are very effective and have achieved volumetric penetration rates of 198 kWH/m$^3$ vs 380 kWH/m$^3$ for passive melting.

A cryobot used as a high voltage hot water drill would be effective if the cryobot allowed for the passing of high-voltage, low current, AC power through a moving fluid to induce resistive heating in the fluid with 100% efficiency. To date, this type of cryobot/drilling system has not been previously implemented because of the inherent challenges in making high volumes of hot water from a high voltage power source. High volume water heaters require a heating element with a very large surface area.

Standard electro-resistive elements for hot water heating systems operate at relatively low voltage and high current, taking advantage of $I^2R$ heating in the element. An electro-resistive element capable of operating at high voltage with sufficient surface area to facilitate rapid heat transfer forces the heater into an impossible geometry.

It is an object of the present invention to facilitate a cryobot or ice penetrator vehicle to achieve high penetration rates by using high-pressure water jets to rapidly transfer heat from the direct high voltage heater system to the ice.

It is another object of the present invention to pass high-voltage, low current, AC power through a moving fluid to induce resistive heating in the fluid with 100% efficiency.

Electric ater heaters have been around for a very long time, dating back to the early 1920's. The basic premise of passing an AC current through a pumped aqueous solution to heat the solution can be found in these early designs. However, the use of these electric water heaters in various applications has been fairly narrow. A critical element missing relates to safety. The existing electric water heater systems are inherently unsafe as they have the potential to place a large common-mode voltage on the exhaust fluid and are, therefore, not fit for commercial use. In other words, in all those prior designs, the fluid coming out of the heater element is charged. The source impedance of this common mode voltage is sufficiently low to cause current flow to safety ground, therefore creating a shock hazard. This problem is exacerbated when dealing with high voltage. As this is high voltage, there is a direct likelihood of grounding if a person interacts with the fluid being discharged. This may explain why the use of direct high voltage water heaters have not been seen ubiquitous anywhere. These electrode boilers or electrode heaters operate at very high voltages and lack a critical "flow-through" feature.

Accordingly, there is a need for a safe direct high voltage flow-through water heater system for an ice penetrating vehicle to convert the power to heat in a very small space to melt the ice. There is also a need for a direct high voltage flow-through water heater system that is inherently safe for residential and commercial use that can convert pure electrical current flow to heat in a very compact space and replace water heaters in homes and businesses at a reduced cost to the consumer, i.e., saving money on the electric bill.

BRIEF SUMMARY OF THE INVENTION

The present invention is a direct high voltage flow-through water heater system that overcomes the problem of how to transmit high voltage power to a remote ice penetrating robot, convert the power to heat in a very small space, and then use that to melt the ice.

The present invention relates to transmitting high voltage power to a remote ice-penetrating robot ("cryobot"), converting the power to heat in a very small space at the front of the cryobot, and then using the heat to melt the ice and provide a path ahead of the cryobot allowing the cryobot to penetrate and progress deeper into a remote ice-covered location, such ice of substantial (e.g., kilometers) thickness, such as, for example, glacial ice caps.

The present invention facilitates a robust cryobot in performing rapid (10 m/hr), deep (500+ m) subglacial access while the cryobot carries an onboard science payload optimized for environmental characterization and life detection. The present invention does so by passing high voltage, low current, AC power through a moving conducting fluid. This induces resistive heating in the fluid with 100% efficiency without inducing electrolysis. The resistivity of the process fluid can be tuned over a wide range by controlling the concentration of polar molecules in the fluid. This tunable resistivity allows unprecedented power densities to be achieved.

The system of the present invention works exclusively with AC power. Direct current (DC) power would cause electrolytic decomposition of the process fluid. Extensive laboratory testing failed to register any hydrogen production when using a 60 Hz AC source at 10 kV, 120 mA with a sodium chloride doped process fluid. Laboratory testing achieved power densities of over 600 kW/Liter, proving this technology is capable of producing massive amounts of hot water in a very small volume.

To penetrate ice containing sediment or debris, large volumes of hot water at greater pressure will need to be produced. To do so, the cryobot design uses a closed-cycle hot water drill approach wherein the water is heated in a novel way: high voltage is applied across a flowing conductive column of water, which serves as the resistive element in an electro-resistive heater. Energy transfer from the electrical source to the water is instantaneous and occurs at 100% efficiency.

The present invention uses alternating current (AC) electricity fed into a tube with flowing water. The amount of energy being pumped into the water is varied electronically, thus, setting the heat coming out the outlet end of the water flow for melting ice in front of the cryobot. Importantly, the present invention is neither an immersion heater nor a gas fired on-demand heater but rather electricity being directly injected into the water flow. Use of DC power in this application would result in an explosion as the DC current would dissociate the water into hydrogen and oxygen. Not so with AC current. The present invention was tailored for 60,0000 volts (AC), but low voltage household 220 AC also suffices.

High pressure jets are essential to enabling penetration through volcanic ash layers in the ice at Skafta or other comparable location and environment. The present invention has not been implemented before because of the inherent challenges in making high volumes of hot water from a high voltage power source.

Direct high voltage heating, combined with new insulation technology, makes possible a compact vehicle that is capable of rapid descent and deep subglacial access with a small field-logistics footprint. The present invention enables a cryobot or other similar ice penetrating vehicle to gain unprecedented persistent access to subglacial environments.

The present invention may be integrated into two types of melt probes—one that melts rapid shallow holes using 220 VAC directly from a generator, and another that goes deeper at lower power and higher voltage.

In an alternative embodiment, the present invention operates at standard residential/industrial mains voltages and runs from 220 VAC as other applications of the present invention include the traditional water heater industry as well. For example, the present invention could be used to make immediate hot water for households in a very compact, simple space that potentially could replace both hot water heaters (traditional) and on-demand heaters. The invention is a cost effective, energy conserving replacement for all water heaters.

The present invention provides several advantages. The present invention operates at household current and voltage levels and is capable of dumping up to 10 kW into a water flow. The present invention is feedback controllable to produce a constant output temperature regardless of flow rate and works over a very wide range of water chemistry, such as with municipal water and well water, both of which have sufficient ionic content, but will not work for extremely pure deionized water. The heater will work over a range of water chemistries due to the feedback loop control system. The present invention is less expensive to produce than current tankless heaters and quite possibly less expensive than tank heaters. Additionally, it is more reliable than both current tank and tankless heaters and nearly 100% efficient. Importantly, the present invention is completely safe.

DETAILED DESCRIPTION OF THE INVENTION

Figure 1:
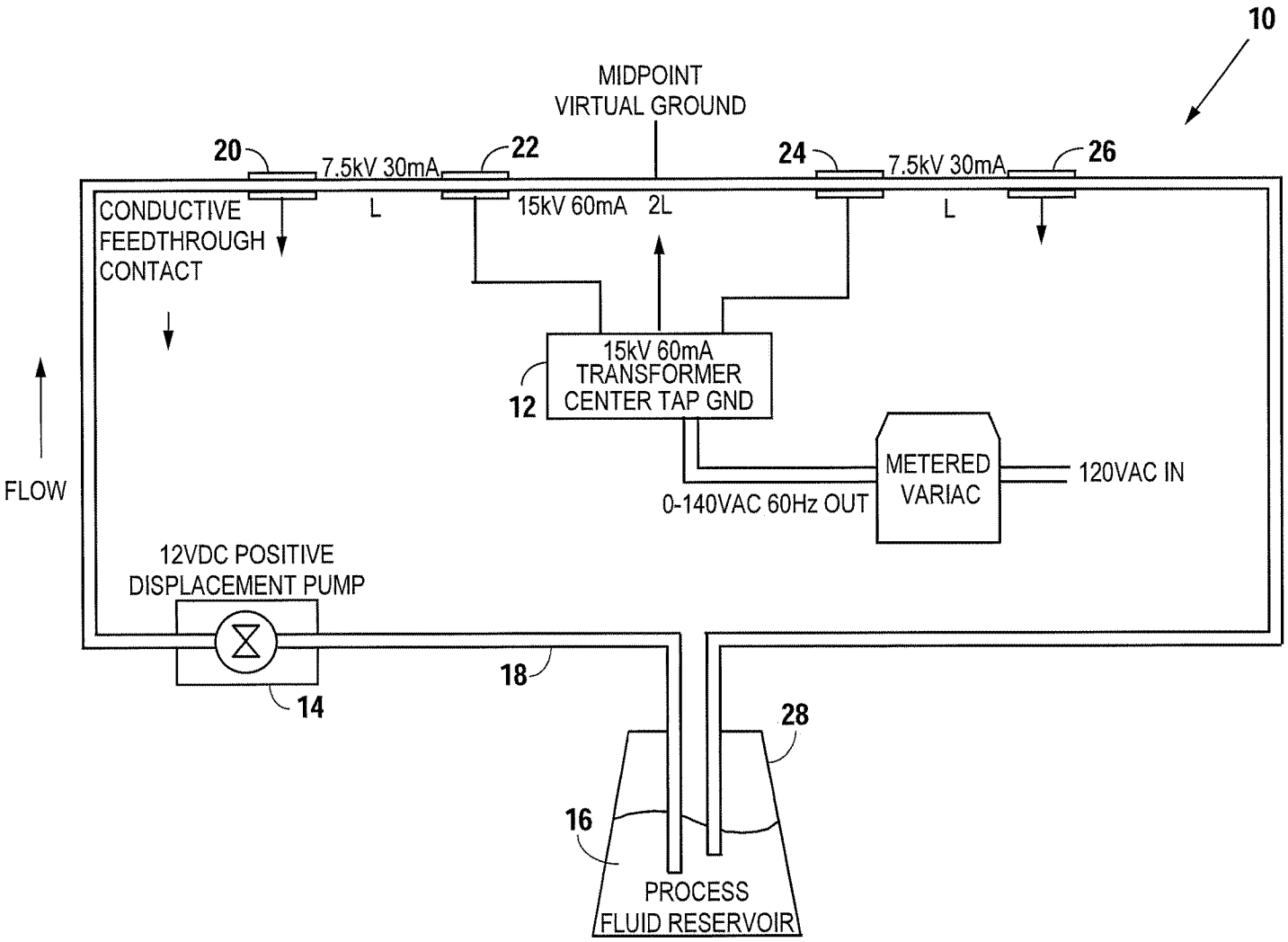
FIG. 1 shows a schematic detailing the present invention.

FIG. 1 depicts a schematic 10 of a 10 kV high-voltage flow through heater. A 10 kV center tapped transformer 12 produces 10 kV phase-to-phase and 5 kV phase-to-ground. Pump 14 circulates conductive fluid 16 (in this case tap water) through non-conducting loop 18. This loop 18 is broken in four locations by conductive sections of tube 20, 22, 24 and 26 that act as electrical contacts to conductive fluid 16. It is critical to note the outer contacts 20 and 26 are held at neutral/ground potential. Therefore, the input water and the output water are stripped of all common mode voltage.

The inner two contacts 22, 24 are connected to the phase outputs of transformer 12. Because the phase-to-neutral voltage is half (½) of the phase-to-phase voltage, the physical length between the phase-to-neutral is half (½) of the length of the phase-to-phase voltage. This maintains the resistance (and current) in each of the three flow-through resistors roughly constant. In reality, the resistance varies somewhat because the output water is hotter and of lower resistivity than the input water. Pump 14 circulated conductive fluid 16 in loop 18. The temperature rise is measured using thermocouples (not shown) in the input and exhaust water streams.

Still referring to FIG. 1, the exhaust water is completely stripped of all common mode voltage before returning to process fluid reservoir 28. This makes the system of the present invention inherently safe—the addition of a ground fault interrupter (GFI) circuit (not shown) between the exhaust fluid and protective earth ground provides active safety for the system.

Figure 2:
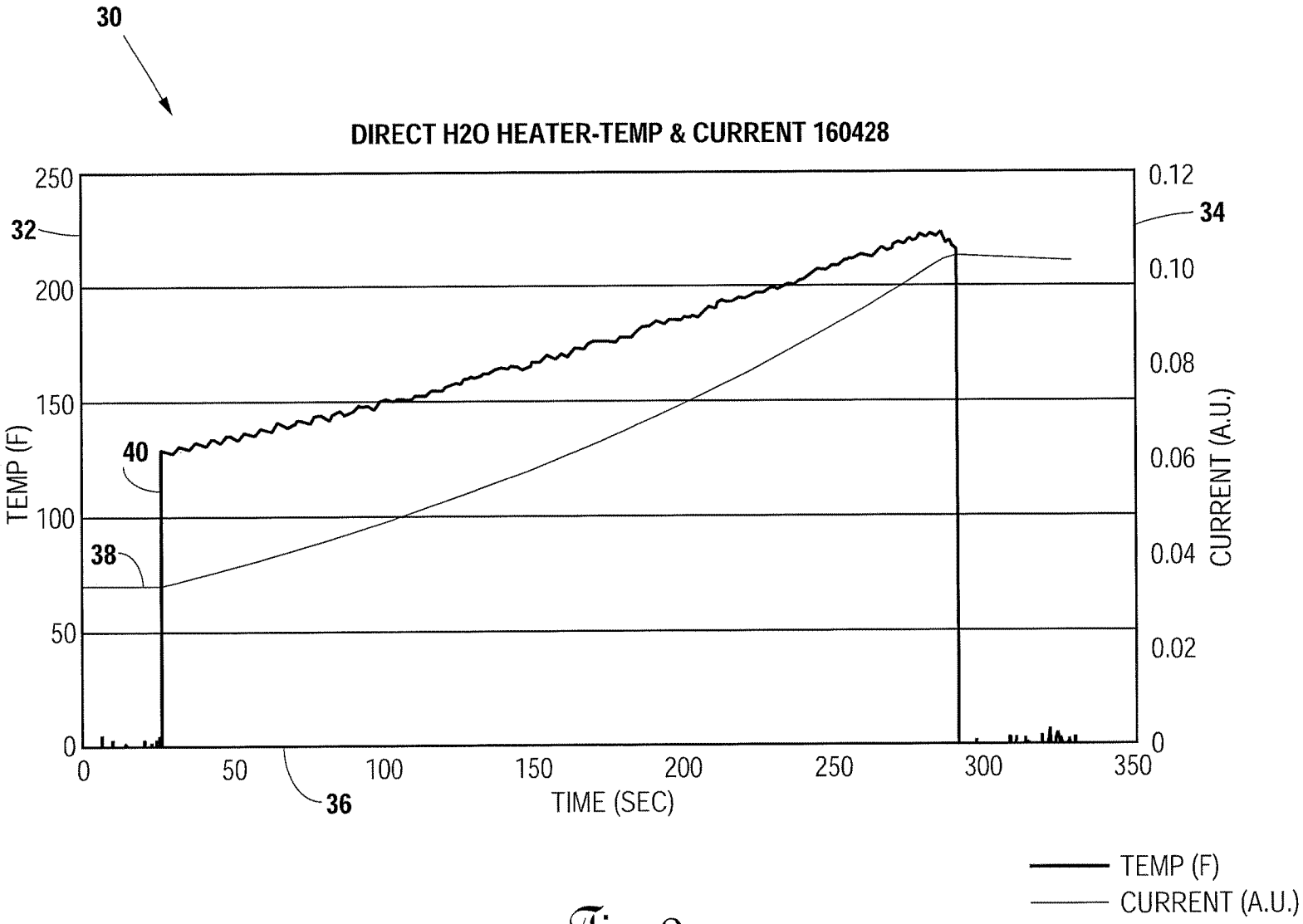
FIG. 2 shows a plot of the temperature (° F.) and current (A.U.) versus time (sec) of the present invention.

Referring now to FIG. 2, a graphical representation 30 illustrates the relationship between the temperature and current of conductive fluid being heated using the present invention. Left axis 32 represents the temperature (° F.). Right axis 34 represents the current (A.U.). Bottom axis 36 represents time (sec).

As shown in FIG. 2, an almost linear and proportional relationship between the current and temperature exists as a function of time. As more current is applied to the conductive fluid passing through the water heater of the present invention, the higher the temperature becomes over time. For example, curve 38 shows a temperature of approximately 70° F. for conductive fluid entering the direct voltage water heater. Curve 40 shows the current initially applied to the conductive fluid which is approximately 0.06 A.U. After almost approximately 290 secs (4.83 min) of continued application of current to the conductive fluid entering the direct voltage water heater, the temperature of the conductive fluid exiting the direct voltage water heater had increased to approximately 220° F.

Figure 3:
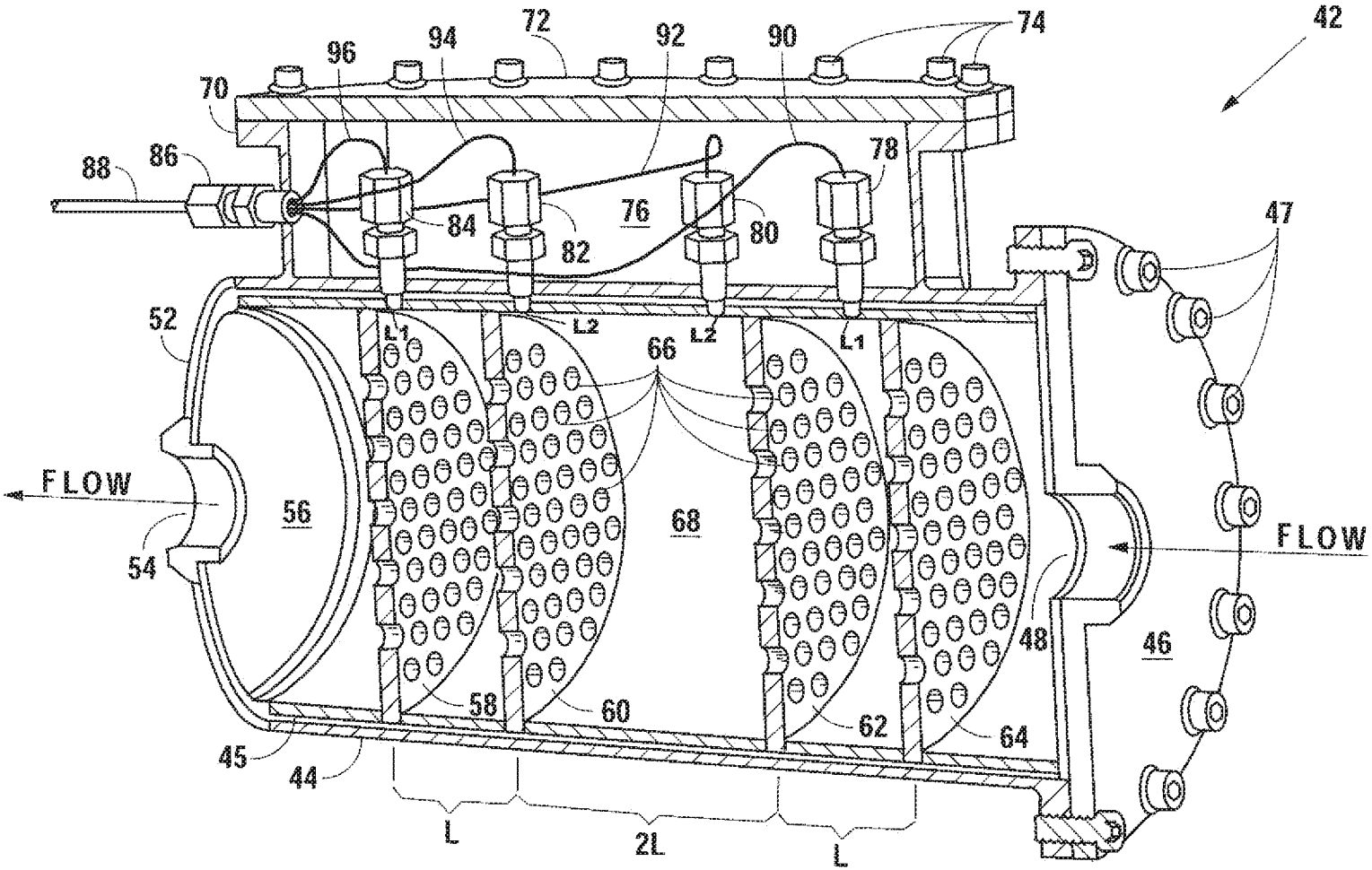
FIG. 3 is a cross sectional perspective view of an embodiment of the present invention.

Referring now to FIG. 3, the direct high voltage water heater 42 of the present invention is shown. Fluid flow (as indicated by the direction of the arrows) is assumed to be from right to left. However, this convention could be reversed and achieve the same heating function while remaining within the contemplation of the present invention. Direct high voltage water heater 42 has housing 44 having end plate 46 at one end. Fasteners 47 removably secure end plate 46 to housing 44. Spacer or insulator 45 lines the inside surface of housing 44, except for the areas in which heater electrodes element plates 58, 60, 62 and 64 traverse and separate insulator 45. Insulator 45 may be comprised of a polyether ether ketone (PEEK) material, though other comparable material may be used and still remain within the contemplation of the present invention. Housing 44 and end plate 46 define a volume 68. End plate 46 contains intake port 48 through which conductive fluid, e.g., melt water, may enter and pass through volume 68. The conductive fluid exits volume 68 at an elevated temperature (hot) via exhaust port 54 at the other end 52 of housing 44. Insulator 56 lines the interior surface (volume side) of end 52. The present invention uses an ethylene propylene diene monomer (EPDM) molded insulator, though other comparable material may be used.

Heater electrodes element plates 58, 60, 62 and 64 are secured within volume 68 of housing 44 at a predetermined distance relative to each other. Each plate contains a plurality of apertures 66 through which conductive fluid may pass. Heater electrode element plates 58, 60, 62 and 64 are arranged from left to right. The first (leftmost) plate 58 is held at neutral potential, corresponding to the center tap of the high-voltage transformer (not shown). The spacing from first plate 58 to the next (second) plate 60 is distance L.

During heating, the conductive fluid between plates 58 and 60 is exposed to a voltage gradient equal to the line-to-neutral voltage of the transformer (not shown). For the present invention, this line-to-neutral voltage is 5 kVAC. The second and third plates 60 and 62 are separated by distance 2L. Third plate 62 is connected to line voltage L2 which exposes the conductive fluid between second plate 60 and third plate 62 to the line-to-line voltage, which, in the present invention is 10 kV.

Spacing between the third and fourth plates 62 and 64 is again distance L. Fourth plate 64 is connected to neutral exposing the conductive fluid between third plate 62 and fourth plate 64 to the line-to-neutral gradient which is 5 kV. As the fluid passes through first plate 58, all common mode voltage is stripped from the fluid rendering the exhaust fluid completely safe for personnel and for any electronic equipment which may come in contact with the exhaust fluid.

Attached to and part of housing 44 is housing 70 having a top end 72. Fasteners 74 removably attach top end 72 to housing 70 to form volume 76. Oil (not shown) fills volume 76 of housing 70. Housing 70 houses several feedthrough fittings 78, 80, 82 and 84. Feedthrough fitting 86 traverses housing 70 and connects to high voltage tether 88. Feedthrough fitting 86 also traverses housing 44 so as to be in electrical communication with heater electrodes element plates 58, 60, 62 and 64. Insulated conductors 90, 92, 94 and 96 connect feedthrough fittings 78, 80, 82 and 84 to high voltage tether 88 via feedthrough fitting 86. The present invention uses CONAX® feedthrough fittings and KAPTON® insulated conductors commercially available, though other comparable fittings and conductors may be used and still remain within the contemplation of the present invention.

Should a fault occur, ground fault interruption circuitry (not shown) detects any current flow between housing 44 and safety ground. If current flow is detected, the fault is reported to mission control and the mission is suspended until further troubleshooting measures can be completed.

Figure 4:
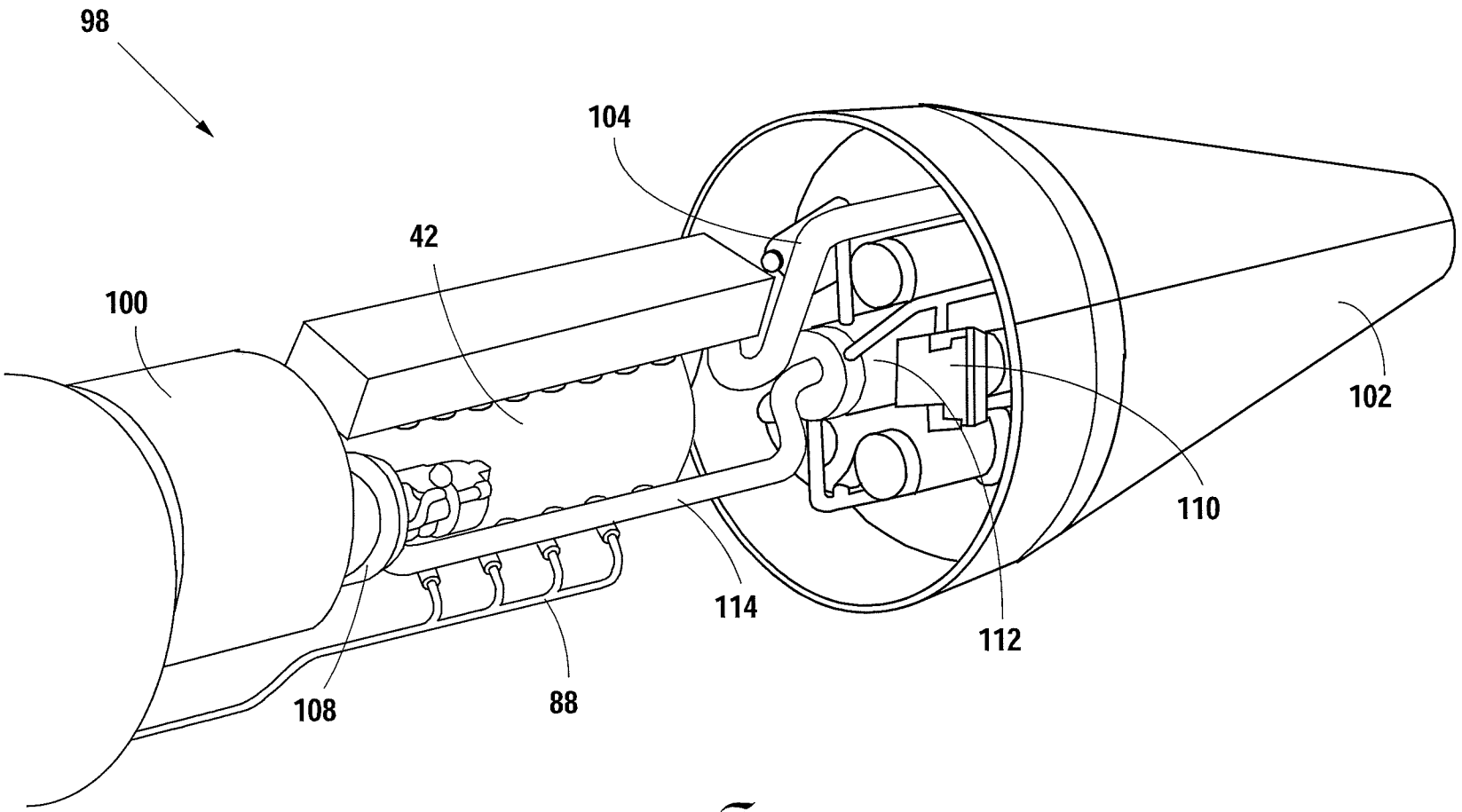
FIG. 4 shows a partial perspective environmental view of an embodiment of the present invention integrated into an ice penetrating vehicle.

Now referring to FIG. 4, the present invention is shown integrated with an ice penetrator vehicle 98 (only a portion of which is shown). The present invention utilizes a closed loop heater system that is in thermal communication through heat exchanger 100 with an open loop hot water drill. The primary heater loop utilizes a process fluid pumped by process fluid pump 108 with a depressed freezing point so the vehicle 98 can restart even after being frozen in the ice for a long period of time.

Primary loop circulation is accomplished by a high volume, low pressure centrifugal pump 108. Process fluid transits through the high-voltage heater core 42 and into the primary side of heat exchanger 100. Meltwater enters inlet ports via melt water intake 104 aft of nose cone 102 and is pumped through the secondary side of the heat exchanger 100 by a series of high pressure, high volume diaphragm pumps. After the water travels through heat exchanger 100, the water is ejected from vehicle 98 via hot water to jet intake 114 in a series of jets 110 that can be turned on or off via a series of solenoid valves 112.

In an alternative embodiment, the present invention may be modified to operate at standard (low-voltage) residential/industrial mains voltages. This is accomplished by changing the spacing between the plates. Referring back to FIG. 3, in the residential/industrial case, the heater runs from 220 VAC. The two outer plates 58, 64 are connected to neutral while the inner plates 60, 62 are connected to line voltage L1 and L2, respectively. This places a 110 VAC gradient across the outer plates 58, 64 and places an 220 VAC gradient across the inner plates 60, 62. Again, the exhaust fluid must pass through the neutral plate 58 before exiting the heater 42, stripping any common-mode voltage from the exhaust fluid.

Flow-rate independent temperature control is achieved by a thermocouple (not shown) in the exhaust port that closes a feedback loop to a controller (not shown). The controller pulse-width-modulates a silicon controlled rectifier (not shown), or zero switch crossing relay (not shown) on the mains voltage. Housing 44 is bonded to earth-ground and ground-fault interruption circuitry monitors current flow from housing 44 to earth ground. Should the current flow exceed a preset threshold the circuitry disconnects direct high voltage water heater 42 from mains power via a mechanical relay. This supplements ground fault interruption circuitry on the 220 VAC mains.

The present invention may be used as a stand-alone unit or incorporated into a high power cryobot or ice penetrating vehicle, in either scenario within a tightly enclosed and small space.

The ice penetrating vehicle that may be used with the direct high voltage fluid heater system of the present invention requires both a closed cycle heating system (which includes the heating element shown in FIG. 3) and an open loop system that draws fluid, such as water, in from the surrounding environment. This was because of the need to maintain a fluid in the heating loop that will not freeze and that had a specified electrolyte content to ensure the electrical power was dumped into the water—because if the vehicle stopped and power was turned off, the ambient water would freeze in the pipes and there would be no flow and it was uncertain whether the vehicle could start back up.

As such, the present invention functions equally proficient in both the case of heating fluids in an ice penetrating vehicle environment as it does in the residential household water heater environment regardless of external temperature or ambient water electrolyte or dissolved mineral content because a clean anti-freeze electrolyte is used in the closed (heating) part of the loop. So, in the instance where the fluid in the loop in FIG. 1 freezes (e.g., someone turns off the power temporarily and the water freezes in Alaska) then the power is turned back on, the system will work. In a similar context, if the ambient water (e.g., groundwater) has no electrolytes or is highly variable or contains too much in the way of dissolved minerals, e.g., limestone as may be found in Texas, the system will still work.

Figure 5:
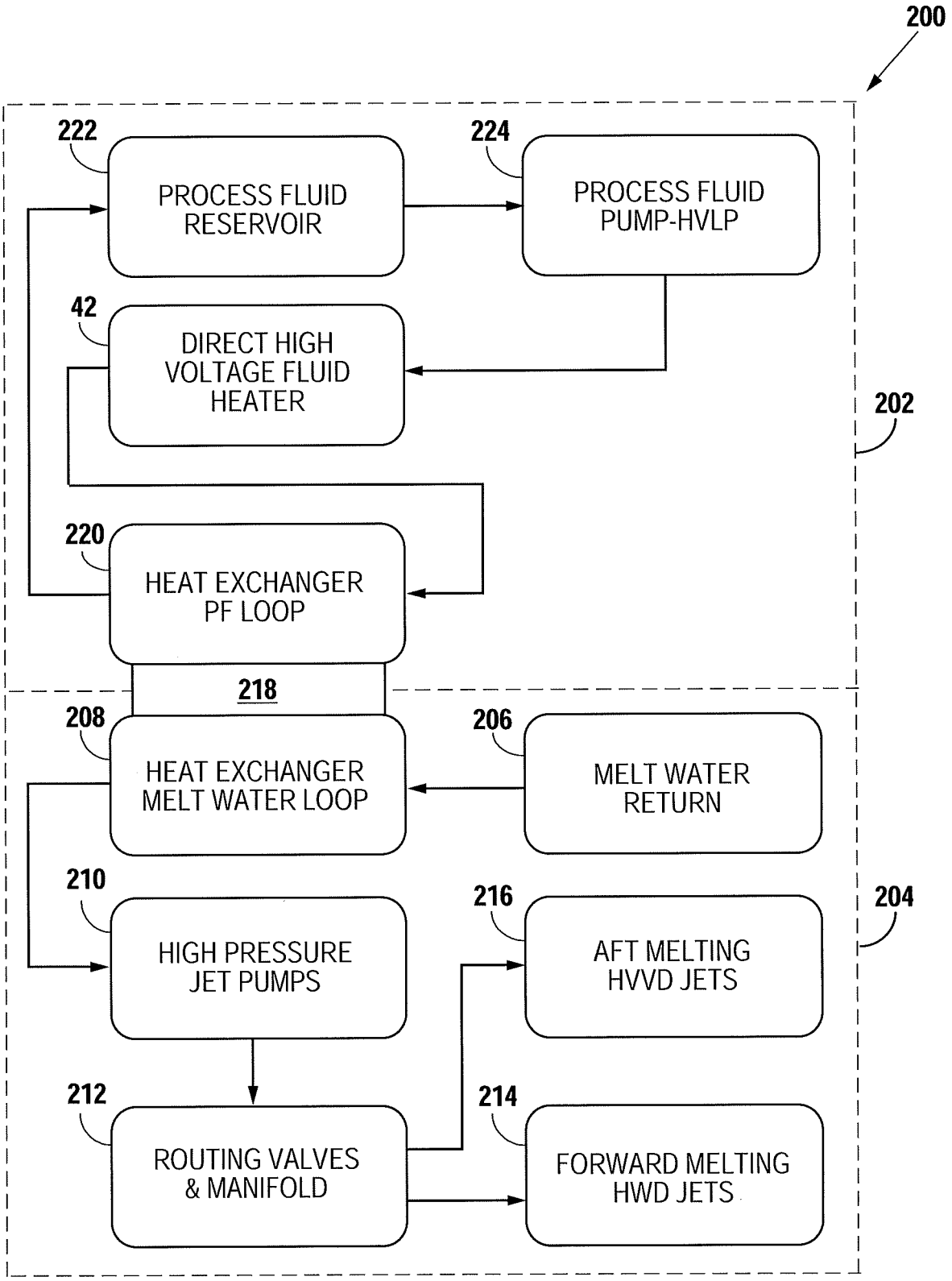
FIG. 5 is a flow chart of an embodiment of the present invention in the context of an ice penetrating vehicle.

This can be demonstrated by reference to the following FIG. 5 which depicts flow chart 200 of the present invention having application in an ice penetrating vehicle. The vehicle contains a closed cycle heating system 202 and an open loop system 204. In open loop system 204, meltwater return 206 enters heat exchanger melt water loop 208.

Heat transfer 218 occurs between heat exchanger melt water loop 208 and heat exchanger process fluid loop 220, with the direction of heat going from heat exchanger process fluid loop 220 to heat exchanger melt water loop 208. Fluid in heat exchanger process fluid loop 220 passes to process fluid reservoir 222 and then to process fluid pump—HVLP 224, ultimately reaching and entering into direct high voltage fluid heater 42 where the fluid is heated. Once the fluid, now heated, flows through and exits direct high voltage fluid heater 42, the fluid continues to heat exchanger process fluid loop 220. At this point, the heat is transferred via heat transfer 218 to heat exchanger melt water loop 208, where the fluid, now heated, passes to high pressure jet pumps 210 and into routing valves and manifold 212, finally directed to both forward and aft melting HWD jets 214 and 216.

Figure 6:
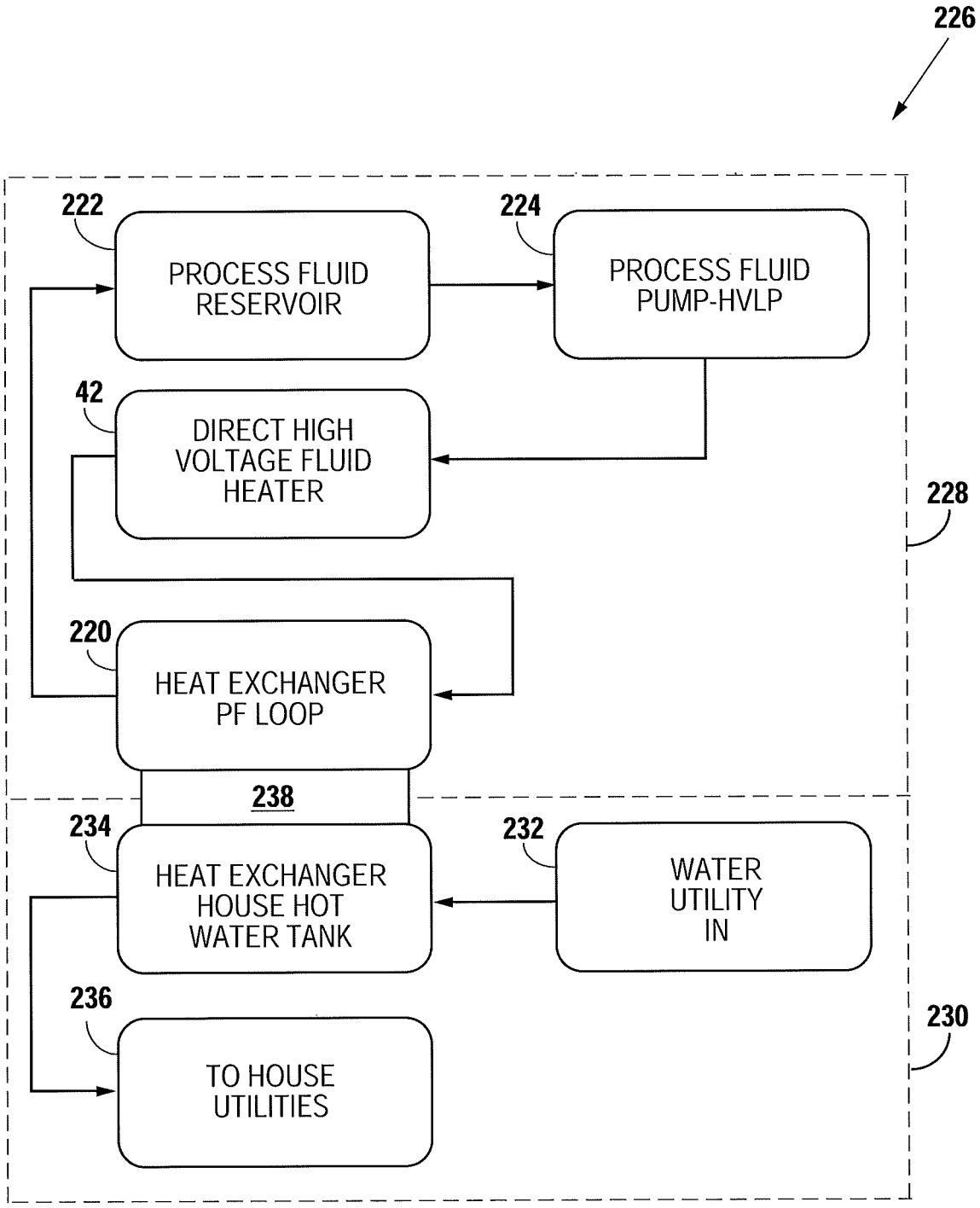
FIG. 6 is a flow chart of an embodiment of the present invention in the context of a household residence.

Referring now to FIG. 6, flow chart 226 depicts an alternative embodiment of the present invention having application for a house hot water heater. The house system similarly contains a closed cycle heating system 228 and an open loop system 230. In open loop system 230, water from the utility enters the system at water utility in 232 and enters heat exchanger house hot water tank 234.

Heat transfer 238 occurs between heat exchanger house hot water tank 234 and heat exchanger process fluid loop 220, with the direction of heat going from heat exchanger process fluid loop 220 to house hot water tank 234. Fluid in heat exchanger process fluid loop 220 passes to process fluid reservoir 222 and then to process fluid pump—HVLP 224, ultimately reaching and entering into direct high voltage fluid heater 42 where the fluid is heated. Once the fluid, now heated, flows through and exits direct high voltage fluid heater 42, the fluid continues to heat exchanger process fluid loop 220. At this point, the heat is transferred via heat transfer 238 to heat exchanger house hot water tank 234, where the fluid, now heated, passes to house utilities 236 and is ready to be used by the consumer. Any heat exchanger that efficiently transfers the heat energy from the heat exchanger process fluid loop 220 (heated by the direct high voltage fluid heater 42) to the house hot water tank 234 will work.

The various embodiments described herein may be used singularly or in conjunction with other similar devices. The present disclosure includes preferred or illustrative embodiments in which a system and method for a direct high voltage water heater are described. Alternative embodiments of such a system and method can be used in carrying out the invention as claimed and such alternative embodiments are limited only by the claims themselves. Other aspects and advantages of the present invention may be obtained from a study of this disclosure and the drawings, along with the appended claims.

We claim:

1. An ice penetrating vehicle system comprising:

an ice penetrating vehicle;

a direct high voltage fluid heater system incorporated into the ice penetrating vehicle, the direct high voltage fluid heater system comprising:

a first housing having a first end and a second end;

an end plate removably attached to said first end of said first housing, said end plate and said first housing defining a first volume;

a plurality of electrode plates of uniformed thickness within said first housing and having a plurality of apertures therethrough, each electrode plate spaced a predetermined distance from each other, there being no contact between electrode plates; said plurality of apertures of one electrode plate in longitudinal alignment with said plurality of apertures of an adjacent electrode plate;

an intake port traversing said end plate;

an exhaust port at said second end of said first housing;

an insulator covering the inside surface of said first housing;

a second housing removably attached to said first housing and forming a second volume therebetween, said second volume filled with an oil;

a plurality of feedthrough fittings in electrical communication with said plurality of electrode plates, said plurality of feedthrough fittings within said second volume of said second housing;

a high voltage tether in electrical communication with said plurality of feedthrough fittings; and a conductive fluid having an ionic content sufficient to facilitate resistive heating, said conductive fluid flowing through said first volume of said first housing, said conductive fluid in electrical communication with said plurality of electrode plates, and wherein said direct high voltage fluid heater system is feedback controllable to produce a constant output temperature regardless of flow rate of said conductive fluid; wherein said direct high voltage fluid heater system is powered exclusively by alternating current and capable of producing power densities of at least 600 kW/L; wherein the energy transfer from said alternating current to said conductive fluid is instantaneous and occurs at 100% efficiency without inducing electrolysis; wherein the amount of said energy transfer may be varied electronically; and wherein said conductive fluid is used to melt ice.

2. The ice penetrating vehicle system of claim 1 wherein said insulator is comprised of a polyether ether ketone (PEEK) material.

3. The ice penetrating vehicle system of claim 2 further comprising a transformer in electrical communication with said plurality of electrode plates, said transformer capable of producing 10 kV phase-to-phase and 5 kV phase-to-ground.

4. The ice penetrating vehicle system of claim 3 further comprising a ground fault interrupter circuit located between an exhaust fluid and protective earth ground, said ground fault interrupter circuit monitoring and detecting current flow between said first housing and said earth ground, and if said current flow is detected exceeding a pre- determined threshold, disconnecting said direct high voltage fluid heater system from mains power via a mechanical relay.

5. The ice penetrating vehicle system of claim 4 wherein said exhaust fluid is stripped of common mode voltage before exiting said first housing.

6. The ice penetrating vehicle system of claim 5 wherein said conductive fluid is water.

* * * * *